United States Patent [19]

Benson

[11] 4,068,688

[45] Jan. 17, 1978

[54] STACKED DISC FINGER JOINT CUTTER ASSEMBLY

[75] Inventor: George E. Benson, Elmira, Oreg.

[73] Assignee: Industrial Carbide Tooling Incorporated, Eugene, Oreg.

[21] Appl. No.: 582,864

[22] Filed: June 2, 1975

[51] Int. Cl.[2] ..... B27G 13/12

[52] U.S. Cl. ..... 144/90 A; 144/36; 144/237; 241/292.1; 299/89; 407/31; 407/61

[58] Field of Search ..... 144/36, 82, 90 R, 90 A, 144/91, 41, 134 R, 218, 231, 236, 237, 136 R, 3 P, 229; 29/104; 241/292.1, 294; 299/39, 89

[56] References Cited

U.S. PATENT DOCUMENTS

| | | | |
|---|---|---|---|
| 1,075,907 | 10/1913 | Dunton | 144/237 |
| 1,428,308 | 9/1922 | Wiard | 144/237 |
| 3,082,802 | 3/1963 | Dickson et al. | 144/3 P X |
| 3,323,567 | 6/1967 | Segal | 144/237 X |
| 3,951,189 | 4/1976 | Cromeens | 144/91 |

FOREIGN PATENT DOCUMENTS

| | | | |
|---|---|---|---|
| 1,285,040 | 1/1962 | France | 29/104 |
| 230,699 | 2/1911 | Germany | 144/237 |
| 1,276,894 | 9/1968 | Germany | 29/104 |

*Primary Examiner*—Othell M. Simpson
*Assistant Examiner*—W. D. Bray
*Attorney, Agent, or Firm*—Kolisch, Hartwell, Dickinson & Stuart

[57] ABSTRACT

A stacked disc cutter assembly for producing finger joints including a plurality of discs, each of which has a plurality of cutter teeth secured to and projecting radially outwardly therefrom. The discs are of substantially similar outer diameter and when assembled and secured together in side-by-side, contiguous, concentric relationship they form a solid cylindrical core for the assembly. The cutter teeth projecting radially outwardly from the discs and so arranged on the discs that they are spaced apart both axially and circumferentially of the cutter assembly.

14 Claims, 4 Drawing Figures

STACKED DISC FINGER JOINT CUTTER ASSEMBLY su

BACKGROUND AND SUMMARY OF THE INVENTION

This invention relates to a stacked disc cutter assembly for producing finger joint cuts in material, and more particularly to such a stacked disc finger joint cutter assembly wherein cutter teeth thereon are spaced apart both axially and circumferentially about the assembly.

In the past, various types of cutter devices have been designed for producing finger joints in material such as wood. For the most part, such devices have had cutter teeth thereon which are closely spaced both circumferentially and axially of the device. Because of this, considerable problems have arisen due to portions of the material being cut (such as splinters) jamming between the cutter elements, this has resulted in problems such as having to shut down the machine to remove the jammed material.

In some previous devices, there is a considerable amount of space extending radially inwardly from the cutter elements toward the center of rotation of the device, into which spaces material being cut may be drawn. The possibility of the workpiece being drawn into the space radially inwardly of the cutting device beyond a preselected point also can produce problems in production and maintenance of the equipment.

A general object of the present invention is to provide a novel finger joint cutter assembly which overcomes the above set out disadvantages of previous devices in a simple and efficient manner.

More specifically, an object of the invention is to provide a novel finger joint cutter assembly which includes a plurality of cutters, each of which includes a disc from which a plurality of circumferentially spaced cutter teeth project. When the cutters are assembled in face-to-face concentric relationship, the cutter teeth are so arranged that they are spaced apart both axially and circumferentially about the assembly. With the cutter teeth thus being spaced apart both axially and circumferentially about the assembly, there is substantially no chance for material being cut to catch in the spaces between the cutter teeth and jam the equipment. Further, the disc portions of the cutters when assembled provide a substantially solid core at the base of the cutter teeth which prevents the workpiece from being drawn radially inwardly of the assembly thus allowing the assembly to consistently produce desired joints without jamming of the equipment occurring.

A further object of the invention is to provide a novel finger joint cutter assembly which comprises a plurality of stacked discs which are easily disassembled for maintenance and which can be simply replaced and interchanged to produce a variety of finger joint configurations.

Yet another object of the present invention is to provide such a novel finger joint cutter assembly in which the cutter teeth are integrally joined to the disc portions of the cutters whereby there is no chance that they will spring away from the material to produce an inaccurate cut when a harder than usual portion of the material is encountered, as has occurred with cutter assemblies of some previous designs.

DRAWINGS

These and other objects and advantages will become more fully apparent as the following description is read in conjunction with the drawings wherein.

DETAILED DESCRIPTION OF A PREFERRED EMBODIMENT OF THE INVENTION

Figures 1, 2, 3, 4:
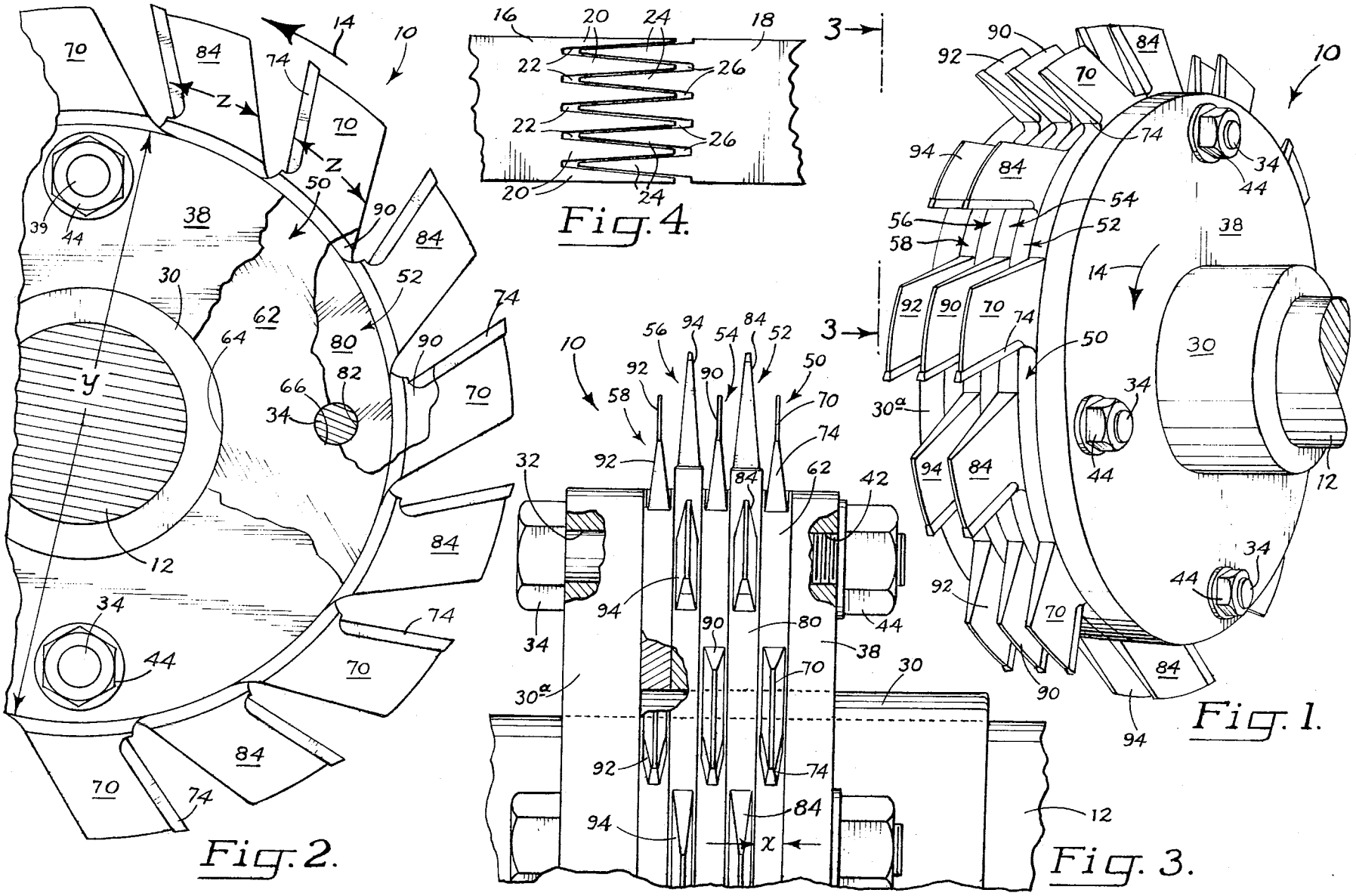
FIG. 1 is a perspective view of a cutter assembly constructed according to an embodiment of the invention.
FIG. 2 is a side elevation view of a portion of the assembly illustrated in FIG. 1, on a larger scale, with portions broken away to better illustrate interior portions of the assembly.
FIG. 3 is an enlarged view of a portion of the assembly taken generally along the line 3—3 in FIG. 1.
FIG. 4 is a view of the edges of a pair of boards having finger-jointed edge margins cut by an assembly according to the invention.

Referring to the drawings, at 10 is indicated generally a finger joint cutter assembly according to the invention. The assembly is mounted on a power-driven shaft 12 for rotation in the direction of arrow 14 in FIGS. 1 and 2. The cutter assembly is operable to produce finger joints in the edge margins of articles such as those illustrated in boards 16, 18 in FIG. 4. As is seen in FIG. 4, the finger joints produced preferably are shaped to provide long, tapering fingers, indicated at 20 for board 16 separated by acute angle notches 22. The bottoms of the notches and outer ends of the fingers have flat surfaces which are disposed substantially normal to the outer faces of the board. Similar fingers 24 separated by notches 26 are provided on board 18 in such a manner that the boards may be joined, as by gluing, with fingers 20, 24 received in notches 26, 22, respectively. The fingers and notches thus provide a large gluing surface to produce a strong joint between the boards. In FIG. 4, the boards are shown spaced apart somewhat to better illustrate the finger joints thereon.

Describing assembly 10, it includes a substantially cylindrical hub 30 having a bore extending therethrough which receives shaft 12. Hub 30 may be keyed, or otherwise secured to the shaft for rotation therewith. As is best seen in FIG. 3, a flange **30*a* projects radially outwardly from one end of hub 30. Flange 30*a* has four bores such as that indicated at 32 therein adapted to receive bolts, such as that indicated generally at 34**.

A disc-shaped cover plate 38 having a bore 40 extending centrally therethrough for receiving hub 30 also has a plurality of bores 42 extending therethrough adapted to receive the opposite ends of bolts 34. Nuts 44 on bolts 34 engage the outwardly facing surface of plate 38.

Mounted on hub 30 intermediate flange **30*a* and cover plate 38 are a plurality of cutters indicated generally at 50, 52, 54, 56, 58. Describing cutter 50, and referring to FIGS. 2 and 3, it includes a central disc portion 62**, which has a preselected thickness "*x*" and a preselected diameter "*y*". which is the same diameter as cover plate 38. A bore 64 extending axially through disc 62 receives hub 30 (see FIG. 2). A plurality of bores 66 similar to that indicated in the broken away portion of FIG. 2 are spaced circumferentially about the disc to receive bolts 34.

A plurality of cutter teeth 70 are formed as an integral part of the cutter and project radially outwardly from disc portion 62. The cutter teeth on a disc are aligned with each other on a line extending circumferentially about the disc portion. As is seen in FIG. 2, all of cutter teeth 70 on disc 62 have substantially the same length "z" measured in a direction extending circumferentially of the cutter. Further, it will be recognized that the cutter teeth are spaced apart circumferentially about the cutter a distance greater than length "z".

As is seen in FIG. 3, the cutter teeth are somewhat thinner than disc 62 to which they are secured and opposite faces of a tooth converge on progressing radially outwardly from the disc.

Secured to the forwardly facing surface of each of the cutter teeth, referred to as the cutting side herein, facing in the direction in which the assembly is to be rotated during operation, is hardened, wear-resistant, cutter face, or element, 74 of a material such as tungsten carbide. The cutter face projects laterally to opposite sides of the opposed converging faces of a cutter tooth 70, and projects radially outwardly beyond the outer edges of the cutter tooth. The carbide cutter face has a configuration which conforms substantially to the configuration of a notch which it is desired to cut in the edge of a board.

Each of cutters 52, 54, 56, 58 is substantially similar to cutter 50 just described. Referring to cutter 52, contiguous to cutter 50, it includes a disc portion 80 having a central bore for receiving hub 30 therethrough and a plurality of bores, such as that indicated at 82 in FIG. 2, adapted to receive bolts 34. Cutter teeth 84, similar to previously described cutter teeth 70, project radially outwardly from disc 80 and also are spaced apart circumferentially about the disc a distance greater than their respective lengths. Bores 82 in cutter 52 and bores 66 in cutter 50, however, are disposed in different positions relative to the cutter teeth on the respective discs. The positioning of the bolt receiving bores 66, 82 is such that when the cutters are assembled as illustrated, teeth 70 and 84 are spaced apart circumferentially about the assembly.

The other cutters in the assembly also are similarly arranged so that the cutter teeth on alternate cutters are substantially aligned in a direction extending axially of the assembly, as illustrated by teeth 70 on cutter 50, teeth 90 on cutter 54, and teeth 92 on cutter 58. Similarly teeth 84 on cutter 52 and teeth 94 on cutter 56 are substantially aligned axially of the assembly.

With such construction and arrangement, when the cutters are secured together in facing, contiguous, concentric relationship as illustrated, the cutter teeth on adjacent cutters are spaced apart both axially and circumferentially of the assembly, whereby there are no closely spaced cutter teeth in which material may become jammed. Further, when nuts 44 are tightened to secure the assembly together the central disc portions of the cutters being of substantially similar outer diameter form a solid core at the base of the cutter teeth to prevent material from being drawn radially inwardly of the assembly during operation.

In such an assembly, once the cutters and cover plate have been placed in position on hub 30 and the bolt receiving bores in the cutters aligned with the bores in flange 30*a* and cover plate 38, bolts 34 may be slipped through such aligned bores and nuts 44 tightened thereon to secure the assembly in operative position. The assembly on rotation with shaft 12 in the direction of arrow 14 is operable to produce finger joints or other desired shapes in materials. Disassembly of the stacked disc cutters is equally as simple by removal of nuts 44 and sliding the cover plate and discs off of hub 30 and shaft 12. This construction also permits discs with cutter teeth of varying sizes and shapes to be inserted into the assembly for producing a variety of desired configurations of finger joints.

While a preferred embodiment of the invention has been described herein, it should be apparent to those skilled in the art that variations and modifications are possible without departing from the spirit of the invention.

What is claimed and desired to secure by letters patent is:

1. A finger joint cutter assembly comprising
   a plurality of cutters, each cutter including a disc of preselected thickness and a plurality of cutter teeth secured to and projecting radially outwardly from said disc, said cutter teeth on a disc being thinner than said disc, having preselected lengths measured circumferentially of said discs and being spaced apart circumferentially about said disc a distance greater than said preselected length, each of said discs being of substantially similar diameter, and
   connecting means for securing said cutters in face-to-face contiguous, concentric relationship with said cutter teeth on adjacent cutters spaced apart axially and circumferentially of said assembly.

2. The assembly of claim 1, wherein said cutter teeth on alternate discs are substantially aligned in a direction extending axially of the assembly.

3. The assembly of claim 1, wherein opposed sides of a cutter tooth converge on progressing radially outwardly from said disc.

4. The assembly of claim 1, wherein said discs have bores extending therethrough, said bores in contiguous discs being so arranged relative to the cutters on said discs that when the bores are aligned in a direction extending axially of the assembly, the cutter teeth on one disc are spaced circumferentially of the assembly from the cutter teeth on a contiguous disc, and said connector means comprises an elongate fastener which extends through aligned bores in said discs.

5. The assembly of claim 1, wherein a cutter tooth on a cutter is formed integrally with said disc and has a cutting side facing in the direction which said assembly is rotated during operation, and which further comprises a hardened, wear-resistant cutter face secured to and covering a portion of said cutting side of said tooth.

6. The assembly of claim 5, wherein said cutter face comprises an element having a face configuration conforming substantially to the configuration of the cut said cutter tooth is to produce in operation of said assembly.

7. The assembly of claim 6, wherein said element projects laterally to opposite sides of said cutter tooth and radially outwardly beyond the outer edge of said cutter tooth.

8. The assembly of claim 1, which further comprises an elongate, cylindrical hub, and each disc has a bore extending axially therethrough adapted to receive said hub.

9. The assembly of claim 1, wherein said cutter teeth on a disc are aligned with each other along a line extending circumferentially of said disc.

10. The assembly of claim 1, wherein said cutter teeth on said discs are of substantially equal length measured circumferentially of said discs.

11. A stacked disc finger joint cutter assembly comprising
   a plurality of cutters, each cutter including a disc of preselected thickness and a plurality of cutter teeth secured to and projecting radially outwardly from said disc, said cutter teeth on a disc being thinner than said disc, having preselected lengths measured circumferentially of said disc and being spaced apart circumferentially about said disc a distance greater than said preselected length, said discs being of substantially similar diameter and having bores extending therethrough, said bores in contiguous discs being so arranged relative to the cutter teeth on said discs that when said cutters are arranged in face-to-face contiguous, concentric relationship with said bores aligned, the cutter teeth on adjacent cutters are spaced apart axially and circumferentially of said assembly and the cutter teeth on alternate discs are substantially aligned in a direction extending axially of the assembly, and connecting means for securing said cutters in said face-to-face contiguous, concentric relationship including a fastener which extends through said aligned bores in said discs.

12. The assembly of claim 11, wherein a cutter tooth on a cutter is formed integrally with said disc and has a cutting side facing in the direction in which said assembly is rotated during operation, and which further comprises a hardened, wear-resistant cutter face secured to and covering a portion of said cutting side of said tooth.

13. The assembly of claim 11, wherein said cutter teeth on a disc are aligned with each other in a line extending circumferentially about said disc.

14. The assembly of claim 11, wherein said cutter teeth on said discs are of substantially equal length measured circumferentially of said discs.

* * * * *